US011291278B2

(12) United States Patent
Gardill

(10) Patent No.: US 11,291,278 B2
(45) Date of Patent: Apr. 5, 2022

(54) COMPACT HOLDER FOR BOTTLE AND ITEMS

(71) Applicant: Michele Rose Gardill, Satellite Beach, FL (US)

(72) Inventor: Michele Rose Gardill, Satellite Beach, FL (US)

( * ) Notice: Subject to any disclaimer, the term of this patent is extended or adjusted under 35 U.S.C. 154(b) by 29 days.

(21) Appl. No.: 16/683,165

(22) Filed: Nov. 13, 2019

(65) Prior Publication Data

US 2020/0146406 A1 May 14, 2020

Related U.S. Application Data

(60) Provisional application No. 62/766,976, filed on Nov. 13, 2018.

(51) Int. Cl.

| | |
|---|---|
| ***A45C 1/06*** | (2006.01) |
| ***A45C 11/18*** | (2006.01) |
| *A45F 5/00* | (2006.01) |

(52) U.S. Cl.

CPC ..... *A45C 1/06* (2013.01); *A45C 11/182* (2013.01); *A45C 2001/062* (2013.01); *A45F 2005/002* (2013.01); *A45F 2005/006* (2013.01); *A45F 2200/055* (2013.01); *A45F 2200/0591* (2013.01)

(58) Field of Classification Search

CPC ... A45C 1/06; A45C 11/182; A45C 2001/062; A45C 2005/002; A45C 2005/006; A45C 2200/055; A45C 2200/0591; A45C 11/043; A45C 2001/065; A45C 2013/1061; G02C 13/006

USPC ..... 224/148.4–148.6, 245, 250, 587; 132/314, 315, 317; 206/229

See application file for complete search history.

(56) References Cited

U.S. PATENT DOCUMENTS

| | | | | |
|---|---|---|---|---|
| 1,613,380 A * | 1/1927 | Broomhall | B42F 9/00 24/67.11 |
| 3,970,129 A * | 7/1976 | Tepfer | A45C 11/18 150/149 |
| 4,796,751 A | 1/1989 | Madkour | |
| 5,607,090 A * | 3/1997 | Brown | A45C 1/04 222/175 |
| 5,669,530 A * | 9/1997 | Cichon | B05B 11/0013 222/153.09 |
| 5,833,093 A * | 11/1998 | Honaker | A45C 11/008 222/175 |

(Continued)

OTHER PUBLICATIONS

Amazon.com, FIDELO Company, "Carbon Fiber Minimalist Wallet," Nov. 8, 2019; https://www.amazon.com/FIDELO-Carbon-Fiber-Minimalist-Wallet/dp/B01MRK8IYF/ref=redir_mobile_desktop?_encoding=UTF8&aaxitk=uHbeAJrizNbim7Nj.NnyBQ&hsa_cr_id=7443176180001.

*Primary Examiner* — Adam J Waggenspack

(57) ABSTRACT

A compact or "minimalist" holder for a bottle and various personal items. The compact holder comprises three members: a bottle member, a protective member, and at least one adjustable band. The bottle member and the protective member are removably coupled by the at least one adjustable band. The compact holder allows access to, storage and protection of various personal item(s) disposed between the bottle and protective member. A variety of personal item(s) can be removably held, stored and protected by the compact holder, and a variety of fluids may be stored by and dispensed from the bottle, including lubricant, cleaners, antimicrobial solution, vitamin solutions, mace, pepper spray, perfume, oils, and lotion.

17 Claims, 5 Drawing Sheets

(56) References Cited

U.S. PATENT DOCUMENTS

| | | | | |
|---|---|---|---|---|
| 5,944,080 | A * | 8/1999 | Podwika | A45C 11/182 150/137 |
| 6,170,651 | B1 | 1/2001 | Taormina | |
| 6,386,776 | B2 * | 5/2002 | Scariano | A45D 34/04 15/222 |
| 6,557,737 | B1 * | 5/2003 | Hanson | A45F 5/00 128/200.14 |
| 7,370,754 | B2 * | 5/2008 | Kushner | B08B 1/00 206/233 |
| 8,006,864 | B2 * | 8/2011 | Fryan | B65D 83/0847 221/96 |
| 8,469,236 | B2 * | 6/2013 | Kharas | B05B 11/3001 222/173 |
| 9,125,464 | B2 * | 9/2015 | Minn | A45C 1/06 |
| 9,392,863 | B2 | 7/2016 | Hamilton | |
| 9,456,679 | B2 | 10/2016 | Willows et al. | |
| 9,775,428 | B2 | 10/2017 | Johnson | |
| 10,080,409 | B2 * | 9/2018 | King | A45C 1/06 |
| 10,206,473 | B2 * | 2/2019 | Haarburger | A45C 13/001 |
| 10,327,525 | B2 * | 6/2019 | Deng | A45C 11/182 |
| 2005/0098591 | A1 * | 5/2005 | Kushner | A45F 5/00 224/269 |
| 2017/0119115 | A1 * | 5/2017 | King | A45C 13/30 |
| 2019/0191579 | A1 | 6/2019 | Mayfield | |
| 2019/0375087 | A1 * | 12/2019 | Liang | A45C 1/08 |

* cited by examiner

200

300

500

COMPACT HOLDER FOR BOTTLE AND ITEMS

CROSS-REFERENCE TO RELATED APPLICATIONS

This non-provisional patent application claims the benefit of provisional patent application 62/766,976, having a filing or 371(c) date of Nov. 13, 2018.

BACKGROUND OF THE INVENTION

Field of the Invention

The field of this invention relates generally to a compact, or "minimalist," holder for personal items, comprising a bottle (e.g., a fluid dispensing container), a protective member, and at least one adjustable band. More specifically, this invention relates to a compact means to keep both a fluid and personal item(s) handy for use.

A bottle within the field of this invention may be any container which can hold and dispense a fluid, and is preferably refillable and reusable. Fluids include but are not limited to, lubricant, cleaners, antimicrobial solution, vitamin solutions, mace, pepper spray, perfume, oils, and lotion.

A protective member within the field of this invention has a surface with a geometric shape which substantially mates to at least a portion of the bottle's outer wall surface geometry. This feature allows personal item(s) to be disposed between the protective member and the bottle, in a compact manner, with minimal gaps.

An adjustable band within the field of this invention may be a strip of fabric, webbing or leather, or other material having two ends that can be joined and adjusted to the proper length, or it may be an elastic band with no distinct ends that may be adjustably stretched. For many applications where the personal items are substantially flat, an elastic band can be sized so that it will hold the protective member and the fluid dispensing bottle even when the personal items are completely removed, thus keeping the compact holder members together until the personal item(s) are returned to the compact holder.

Personal items within the field of this invention include, but are not limited to, item(s) from the group consisting of a cleaning cloth, money, credit card, identification card, business card, prepackaged condom, prepackaged bandage, transdermal patch, ear buds, and small electronic device, or combinations or multiples thereof.

Description of Related Art

There are currently products sold ("minimalist wallets") that hold credit cards, identification cards, and money between two inflexible protective members held together by an elastic band. These products do not include a bottle as part of the holder to store items; they are not designed as a compact holder which allows fluid to be dispensed while it is still part of the compact holder; and they are not designed to use only one protective member.

Current holders for personal items do not teach the means to compactly utilize a bottle and a protective member to hold personal items. In these currently available holders, the holder is an entirely different and separate article from a bottle.

There are currently small dispensing bottles that hold small amounts of fluids such as perfume, oils, or antibacterial solution. But these bottles do not include a mating protective member and adjustable band so that the bottle can form one of the necessary members of a compact holder.

Inventions exist to hold bottles, but they are not designed to allow dispensing of the fluid while the bottle is held by the holder; nor do they comprise a replaceable, reusable or refillable bottle which is a member of a compact holder for personal item(s.)

Some existing designs feature seatbelt webbing, leather, cloth, or other flexible materials to form a sleeve which may hold a bottle or other item. Forming a sleeve requires sidewalls, which add unnecessary bulk and may obstruct the user's view of the personal item(s) or amount of fluid remaining. Further, these designs require extensive stitching, gluing, welding, or other forms of "secondary manufacturing processes" so that one piece of flexible material can be attached to another piece of flexible material to form the sleeve. Another drawback is that the sleeve limits the ability for the item inside to air out, since the sleeve substantially surrounds the item.

Other inventions provide for a bottle and cleaning cloth, but are not compact since they include a relatively large compartment to contain the bottle entirely, the cleaning cloth, and in some cases a pair of eyeglasses. Or, they are not compact because their holders comprise bulky hinged lids, or multiple layers or sidewalls.

There exists, therefore, a need for a compact holder which keeps both a fluid and personal item(s) handy. Consider, for example, the need for a compact holder for antiseptic fluid and bandages; for lens cleaner fluid and microfiber cloth; or for lubricant and condoms. These fluid-personal item pairs are best kept together in a compact holder that can fit into a personal receptacle; such as inside a car's glove compartment, or in a credit-card sized pocket in a purse lining, or inside a pants pocket. In these personal receptacles, any unnecessary bulkiness (such as a second protective layer adding only fractions of an inch) often render existing holders too large to fit.

OBJECTS OF THE INVENTION

This invention has several objects that address the problems and deficiencies with the field of this invention.

One object of this invention is to provide a compact holder capable of fitting inside a personal receptacle, which keeps a dispensable fluid and personal item(s) handy.

Another object of this invention is to eliminate bulk by utilizing the bottle as a member of the compact holder to facilitate storage and protection of personal items.

Another object of this invention is to allow the bottle's fluid to be dispensed while it is still part of the compact holder, and while the compact holder is held in one hand.

Another object of this invention is to eliminate the need for secondary manufacturing methods to produce the compact holder's members.

Another object of this invention is to promote reusability of the compact holder by allowing easy and complete separation and replacement of the individual members with the same or slightly different members, and refillability of the bottle member when the fluid is depleted.

Another object of this invention is to provide flexibility for what may be held by the compact holder by using one or more adjustable bands.

Another object of this invention is to eliminate unnecessary side walls on the compact holder to reduce bulk and to provide the means for a wetted personal item to dry out after use Another object of this invention is to allow visibility of the compact holder's members and contents. Because sidewalls are minimized, and because the protective member and/or bottle may be clear or translucent, the user can see the personal items and/or the amount of fluid remaining at a glance.

Another object of this invention is to make storage of personal items(s) compact and minimalist by having a protective member and bottle that substantially geometrically mate.

Yet another object of the invention is to provide the means to attach the compact holder to another object when the compact holder is not substantially inside a personal receptacle.

Terminology Used to Describe the Invention

A brief summary of some of the terminology used to describe the invention is provided below. These terms are further explained in context throughout this disclosure.

Adjustable band, or band—a thin, substantially flat piece which can either be adjustably joined such as by tying, or with a slidable buckle or hook-and-loop material; or which may be an elastic construction having no adjoining or distinct ends. The adjustable band may be comprised of materials including, but not limited to, leather, cloth, webbing, elastomers, or combinations thereof.

Bottle, bottle member, or fluid dispensing bottle—the component of the compact holder which forms one of two substantially mating surfaces between which the personal item(s) is disposed (the protective member forms the other surface) and with which the personal item(s) is contiguous. It is a container having any shape which can hold a fluid and dispense said fluid. It is preferably a reusable and refillable container. This includes, but is not limited to, "bottles" in the conventional sense which have a dispensing neck opening, tubes which may have a dispensing rollerball, and jars which may have a dispensing airless pump mechanism. The bottle itself may flex, but must substantially hold its shape since it is a member of the compact holder for a personal item(s).

Cavity—a concave portion of the protective member which provides additional space, or volume, between the bottle member and protective member to accommodate personal item(s).

Compact holder—the invention, comprising a bottle member, a protective member, and at least one adjustable band member.

Composite material, composite—a material comprised of two or more constituent materials having significantly different physical or chemical properties. When the two or more constituent materials are combined, individual constituents remain separate with the resulting material having properties different from the individual constituents. Examples include, but are not limited to, reinforced plastics (e.g., fiber-reinforced polymer or fiberglass), ceramic matrix composites (e.g., composite ceramic and metal matrices) and metal matrix composites.

Cleaning cloth—a soft and flexible material. It may comprise a synthetic or natural fabric, wiping media, or microfibers. It may further be a fabric or media designed to clean lenses or electronic screens.

Cutout—refers to a section of a material that has been removed or cut out.

Elastic, elastomer(s), elastomeric—a material property characterized by the ability to elongate, stretch or deform without failing (e.g., tearing or breaking) and then substantially return to an original size and shape. It is understood by those skilled in the art that a reference to elastic or elastomeric materials of construction include, but are not limited to, silicones, silicone co-polymers and thermoplastic elastomers (TPE).

Fashionwear—includes, but is not limited to, artwork, jewelry, stones, jewels, perfume or other oil diffusers, logos and trademarks.

Fluid dispensing bottle—see bottle.

Fluid dispensing mechanism—the means by which a fluid can be dispensed from a bottle. The fluid dispensing mechanism provides the dispensing of fluid from a bottle so that the fluid exits in the form selected from the group consisting of droplet(s), stream, film, spray, mist, or combinations thereof.

Foldable joint—refers to a material having the ability to fold from a substantially planar state to form a material that exists in two planes, and/or may involve a separate joint of the same or other materials or constructions that connects two distinct segments of a material.

Geometry—refers to the two- or three-dimensional shape of an object.

Mate, mates, mating—mimicking the geometry of at least a portion of one object; such that if a second object is placed over that portion of the first object, then the surfaces of the first and second objects are substantially contiguous and gaps between the two surfaces are substantially non-existent over that portion. In the specific context of this invention, therefore, it is understood to mean that at least a portion of a protective member surface and bottle surface can be made substantially contiguous when the two- or three-dimensional geometry's of the protective member and bottle are substantially the same.

Member—any of the three (3) components comprising this invention's compact holder: the adjustable band (member), the protective member, and the bottle (member).

Personal item—includes, but is not limited to a cleaning cloth, money, credit card, identification card, business card, prepackaged condom, prepackaged bandage, transdermal patch, ear buds, and small electronic device, or combinations or multiples thereof.

Personal receptacle—examples include, but are not limited to, a purse, a pocket, a car's glove compartment, and a bicycle's under-seat travel pouch.

Plane, or planar—refers to a two-dimensional geometry that is not curved.

Planform—refers to the projected two-dimensional shape of an object onto a surface, and can be thought of as a shadow that would be cast by an object.

Primary manufacturing—processes commonly used to make commercially available members.

Protective member—the component of the compact holder which forms one of two substantially mating surfaces between which the personal item(s) is disposed (the bottle forms the other surface) and with which the personal item(s) is contiguous. The protective member may be flexible or stiff, solid or perforated. It may be a variety of shapes. It may contain cut out portions which allow access for dispensing fluid from the bottle.

Secondary manufacturing—processes beyond primary manufacturing which are required to render members fit for use in a holder, such as cutting, gluing, or sewing.

BRIEF DESCRIPTION OF THE INVENTION

This invention is a compact or "minimalist" holder for a fluid dispensing bottle and various personal items. The compact holder comprises three members: a bottle member, a protective member, and at least one adjustable band. The bottle member and the protective member are removably coupled by the at least one adjustable band. The compact holder allows access to, storage and protection of various personal item(s) disposed between the bottle and protective member. A variety of personal item(s) can be removably held, stored and protected by the compact holder.

The protective member preferably further comprises a cutout section so that the bottle's contents may be dispensed without obstruction through the bottle's fluid dispensing mechanism.

The bottle may be filled with fluids, including but not limited to, lubricant, cleaners, antimicrobial solution, vitamin solutions, mace, pepper spray, perfume, oils, and lotion.

The invention can be placed inside a personal receptacle, including but not limited to, a purse, a pocket, a car's glove compartment, and a bicycle's under-seat travel pouch.

Optionally, the invention may be removably attached to other objects by using the adjustable band as the attachment means when the compact holder is not inside a personal receptacle. For example, the adjustable band may be placed over a hook that is affixed to another object.

BRIEF DESCRIPTION OF THE DRAWINGS

FIG. 1A, FIG. 1B, and FIG. 1C illustrate invention embodiment 100 comprising a bottle 110, protective member 120 and adjustable band 105.

DETAILED DESCRIPTION OF THE INVENTION

Figures 1A, 1B, 1C:
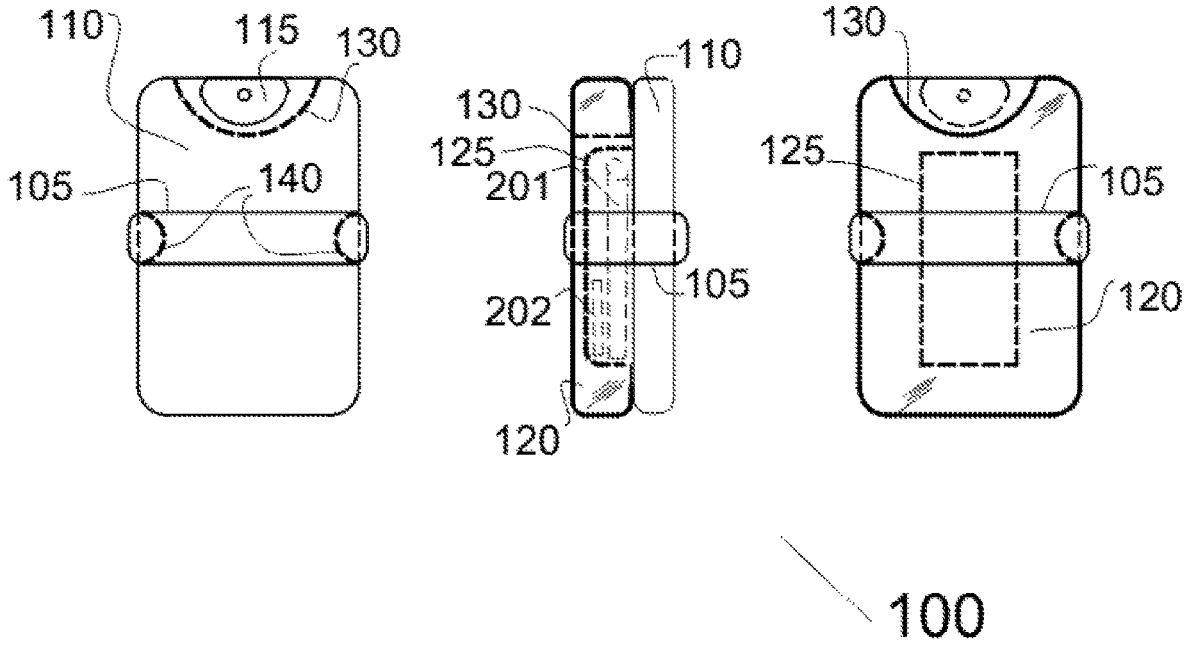
FIG. 1A, FIG. 1B and FIG. 1C are front, side and back views, respectively, of one embodiment of this invention.

This invention is a compact or "minimalist" holder for a fluid dispensing bottle and at least one personal item(s). The compact holder comprises three members: a bottle member, a protective member, and at least one adjustable band. The bottle member and the protective member are removably coupled by the at least one adjustable band. The compact holder allows access to, storage and protection of various personal item(s) disposed between the bottle and protective member. The personal item can be removed from and placed back into the compact holder. When the at least one personal item is stored in the compact holder, the at least one personal item will be contiguous with both the bottle and protective member surfaces. A variety of personal item(s) can be removably stored and protected by the compact holder.

The design of the invention provides a means for holding, or storing, and protecting personal item(s) including, but not limited to a cleaning cloth, money, credit card, identification card, business card, prepackaged condom, prepackaged bandage, transdermal patch, ear buds, and small electronic device, or combinations of multiples thereof.

The at least one adjustable band that couples the bottle member to the protective member further provides the means to store the personal items for easy access by applying compressively adjustable force between the bottle member and protective member. Additional adjustable bands may be used to accommodate personal items requiring more storage support, personal items of different sizes or thicknesses, or to hold more than one personal item.

The adjustable band (e.g., 105 in FIG. 1A through FIG. 1C; 205 in FIG. 2A, FIG. 2B, and FIG. 2D; and 205 and 305 in FIG. 3A, FIG. 3B, and FIG. 3D) can be comprised of synthetic or natural fabric or leather with a means of cinching and closure, or can be comprised of an elastomer such as silicone or rubber (which gives the advantage that the band can be continuous), or can be a combination thereof. The adjustable band may therefore be comprised of a material selected from the group consisting of, but not limited to, fabric, leather, hook-and-loop (Velcro®), elastomer, and combinations thereof.

It is also contemplated that more than one adjustable band could be used with the invention. As illustrated by embodiment #3 of this disclosure, more than one adjustable band can also provide for additional storage means for personal items.

The bottle member and the protective member are removably coupled by the at least one adjustable band. The at least one adjustable band of the invention allows personal item(s) to be protectively stored by, completely removed from, and replaced back into the compact holder. The at least one adjustable band allows the personal items to be accessed easily: either by removing the at least one adjustable band, by opening or loosening the at least one adjustable band, by stretching the at least one adjustable band, or by repositioning or bending the protective member with the adjustable band still in place so as to access the items. Thus, the stored items may even be accessed using just one hand.

The bottle member and the protective member may be removably coupled by more than one adjustable band. Using more than one adjustable band provides additional support for larger or more bulk personal item(s) removably disposed between the bottle member and protective member. The at least one adjustable band allows various shapes and thicknesses of personal items to be held or stored between the protective member and the bottle.

The bottle can be comprised of flat or rounded outer walls and surfaces, and is not readily collapsible although it can be flexible. Flat refers to a bottle having substantially planar geometry. One preferred embodiment of this invention comprises a substantially flat, rectangular, substantially non-collapsible bottle. Other embodiments, including but not limited to, cylindrical or oval bottles, are also contemplated.

The bottle may be comprised of a material selected from the group consisting of, but not limited to, wood, metal, glass, plastics, elastomers, composite material, and combinations thereof.

Preferred embodiments of the fluid dispensing mechanism which delivers fluid as droplet(s), stream, film, spray, mist, and combinations thereof; may be a nozzle, bottle opening, or orifice. The fluid contents of the bottle may be dispensed unobstructed while removably coupled to the protective member in various ways, including for example: by pressing a pump spray nozzle, by removing a cap and then pouring or then squeezing the bottle, or by flipping open a fliptop cap and squeezing the bottle.

To facilitate unobstructed dispensing of the bottle's fluid, the protective member preferably further comprises a cutout section in the area of the fluid dispensing mechanism. For example, the protective member cutout allows access to the neck area of the bottle so that a finger can activate a sprayer or a hand can open a cap, or fluid can be dispensed without interference from the protective member by pouring or squeezing the bottle.

The bottle may be filled with fluids, including but not limited to, lubricant, cleaners, antimicrobial solution, vitamin solutions, mace, pepper spray, perfume, oils, and lotion. Further, the bottle is preferably reusable, replaceable and refillable with these fluids.

In a preferred embodiment, the two- or three-dimensional geometry of the protective member surface contiguous with the personal items(s) and the two- or three-dimensional geometry of the bottle surface contiguous with the personal item(s) are substantially mated at least at the location or portion of the compact holder where the personal item(s) are disposed between the protective member and bottle. This geometric mating of the protective member and bottle surfaces where these surfaces are contiguous with the personal item(s) minimizes any gaps or wasted space, and therefore minimizes the overall size of the compact holder when storing personal item(s). The protective member surface may have a planar, curved or any two- or three-dimensional geometry to substantially mate with at least a portion of the bottle's outer wall surface geometry.

The protective member substantially maintains its shape even after multiple uses of the compact holder, i.e., after the compact holder has been used repeatedly for dispensing fluid and removing/replacing personal item(s).

One preferred planform shape of the protective member is substantially rectangular, however, other planform shapes such as square, oval, polygonal and circular are contemplated.

The corners or edges of the protective member may be rounded or curved. The edges of the protective member may be shaped to help accommodate and position the adjustable band.

The protective member may be clear, translucent or opaque. A clear protective member provides the advantage of being able to see the personal items through it while it is still coupled to the bottle. The protective member may be solid or perforated construction. A perforated protective member may provide an additional advantage of breathability for the stored personal items, e.g., when one of the storage items is a cleaning cloth that has been dampened with lens cleaner and used to clean eyeglasses or other lenses or screens.

The protective member may be comprised of, or coated with, radio frequency identification ("RFID") blocking material. The bottle may also be comprised of, or coated with RFID blocking material.

If the personal item must be aired out or allowed to dry (such as a used, moist cleaning cloth which is prone to mildew or odor), or if bulk must be minimized as much as possible, the protective member may be perforated, and/or have few or no sidewalls. For example, a preferred embodiment has no side walls on a substantially flat protective member. This allows the personal item(s) to air out, while also minimizing the compact holder's bulk.

The protective member may also comprise a cavity that encloses and protects the stored personal item(s) between said protective member and said bottle, and is contiguous with the personal item(s). The cavity may provide additional space, or volume, to accommodate additional personal item(s) or bulkier personal item(s.) A cavity in the protective member does not preclude the protective member and bottle being substantially geometrically mated.

The protective member may also comprise a foldable joint, or bifold, which allows the protective member to wrap or fold around the bottle and personal items so that only the surface of the protective member (with the exception of the unobstructed dispensing portion of the bottle) is substantially visible when the bifold is not open. This embodiment has advantages of disguising, concealing or enhancing the appearance of the bottle (with the exception of its dispensing portion) and stored personal item(s) with the protective member's materials including, but not limited to leather, wood, metal, glass, plastics, elastomers, composite material, and combinations thereof.

The intent of the bifold embodiment is not to provide structural support to the bottle, but to provide a means to conceal or disguise the bottle or personal item(s) from view, with minimal additional bulk.

The at least one adjustable band may be comprised of a material selected from the group consisting of, but not limited to, fabric, leather, hook-and-loop (Velcro®), elastomer, and combinations thereof.

The at least one adjustable band may be completely removable from the protective member, or may have one or more attachment points to the protective member.

The protective member, the adjustable band, and the bottle may have aesthetic or functional details. For example, fashionwear details may be added for aesthetics. Ribbing or texturing may be added to increase functionality.

In another preferred embodiment of this invention, at least one personal item stored by the invention is a cleaning cloth comprised of silk, microfiber, or other synthetic or natural fabrics or wiping media. A cleaning cloth can be used for applying the bottle's fluid contents, or for absorbing, cleaning, or polishing.

This invention also provides for additional storage of personal item(s) such as a cleaning cloth, money, credit card, identification card, business card, prepackaged condom, prepackaged bandage, transdermal patch, ear buds, and small electronic device, between the adjustable band(s) and a surface of the protective member or bottle.

A preferred embodiment allows the bottle's fluid to be dispensed while the bottle is still coupled to the protective member of the compact holder, and while the compact holder is held in one hand. As an example, this allows a user to hold eyeglasses to be cleaned in one hand while simultaneously dispensing the cleaning fluid from its compact holder (which also contains and allows access to the cleaning cloth) in the other hand, without needing to find a surface on which to rest the compact holder.

In one preferred embodiment of this invention, the primary manufacturing methods used for making each member are sufficient: the user simply places the adjustable band around the bottle and the substantially mating protective member (which in turn hold the personal items between them.) In other preferred embodiments, only minimal secondary manufacturing methods are required: wherein the band(s) is sewn, glued, or otherwise attached to the protective member.

In another preferred embodiment of this invention, the protective member and the bottle are clear or translucent, allowing the user to easily view the personal item(s) and amount of fluid remaining in the bottle.

The invention promotes reusability of the compact holder by allowing easy and complete separation and replacement of the individual members with the same or slightly different members, and refillability of the bottle member when the fluid is depleted. For example, the bottle can be easily completely separated from the protective member and replaced with another bottle which may hold a different fluid or be of a slightly different shape; the protective member can be easily completely separated from the compact holder and then replaced, perhaps with a plurality of protective members, or perhaps with a protective member which is slightly thinner or of different fashionwear or color; the adjustable band can be easily and completely separated and replaced with another adjustable band, or with a plurality of adjustable bands. This feature allows for cleaning, replacing and modifying the individual members—rather than forcing the entire compact holder to be discarded if just one member needs changed out.

The invention can be carried inside a purse, bag, pocket or other personal receptacle. Optionally, and when the compact holder is not substantially inside a personal receptacle, the invention may be removably attached to other objects by using the adjustable band as the attachment means. For example, the adjustable band may be placed over a hook, so that the invention hangs from the hook.

The following are contemplated embodiments of the invention for illustration. All figures are not necessarily to scale. It will be understood that these embodiments are not an exhaustive list, and that many variants, modifications and combinations of the invention embodiments may be effected within the spirit and scope of the invention as described in the appended claims.

Invention Embodiment #1

One embodiment 100 of this invention is illustrated by FIG. 1A, FIG. 1B, and FIG. 1C and comprises a small flat bottle 110 with dispensing mechanism 115 (depicted here as a spray nozzle), a protective member 120 comprising a cutout section 130 so that the dispensing mechanism 115 may be accessed and utilized while the bottle 110 is still in place with the protective member 120, and adjustable band 105 that couples the bottle 110 to protective member 120. One preferred embodiment of the invention is to provide a fluid cleaner in a flat bottle 110, and a personal item 201 (e.g., cleaning cloth) in cavity 125. Other personal items 202 could also be stored in cavity 125 along with the personal item 201. This embodiment provides the user with a compact, portable and personal eyeglass, goggles, or cellphone cleaning kit. A lens cleaner in bottle 110 and cleaning cloth (personal item 201) can also be used to clean camera or binocular lenses, or to clean a computer monitor or tablet screen.

Personal item(s) may be removably stored between the protective member 120 and the bottle 110, or within optional cavity 125 that is formed as part of the protective member 120. The optional cavity 125 provides additional space between the protective member 120 and bottle 110, and is contiguous with the stored personal item(s). Cavity 125 can hold or store personal item 201 such as a cleaning cloth or other personal items including, but not limited to, money, credit card, identification card, business card, prepackaged condom, prepackaged bandage, transdermal patch, ear buds, and small electronic device, or combinations or multiples thereof, depicted collectively by personal item 202 in FIG. 1B.

Figure 5A:
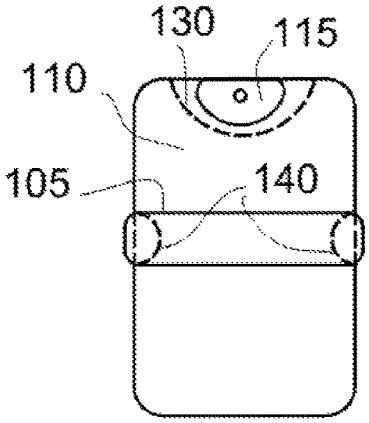
FIG. 5A, FIG. 5B and FIG. 5C are front, side and back views, respectively, of another embodiment 500 of invention similar to embodiment 100, except that protective member 520 comprises no sidewalls or cavity.
Figure 5B:
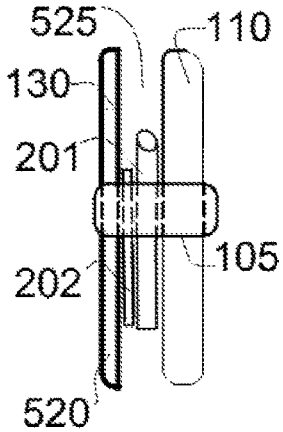

Cavity 125 can be completely enclosing to the personal items (as depicted in FIG. 1B), or the cavity may be non-enclosing (i.e., open) on one or more sides (as depicted in FIG. 5B.)

The personal items 201 and 202 can be removed from, and replaced back into, the optional cavity 125 by lifting the protective member 120 away from the bottle 110, either by leaving the adjustable band in place and allowing it to flex (assuming it is elastic), or by removing or loosening the adjustable band (assuming its ends are closed by an adjustable means). The adjustable band 105 allows the protective member 120 and bottle 110 to be separated enough to access cavity 125. Also, the adjustable band 105 allows varying thicknesses of personal items 201 and 202 to be held between the bottle 110 and the protective member 120. Additional items may also be stored between adjustable band 105 and bottle 110, or between adjustable band 105 and protective member 120.

To help position and secure the adjustable band 105, at least one cutout section (or cutout) 140 may be provided on the edge(s) of the protective member 120. FIG. 1A depicts an embodiment whereby there are two cutouts 140. These cutouts also reduce the profile of the adjustable band, and minimize "catching" on other personal items or clothing.

Invention Embodiment #2

Figure 2A:
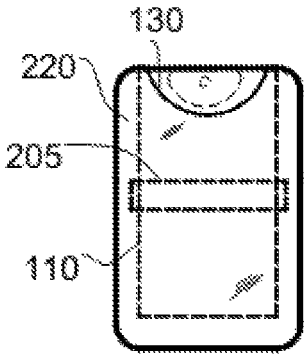
FIG. 2A, FIG. 2B and FIG. 2C are front, side and back views, respectively, of a second embodiment 200 of this invention comprising a bottle 110, bifold protective member 220, and adjustable band 205.
Figure 2B:
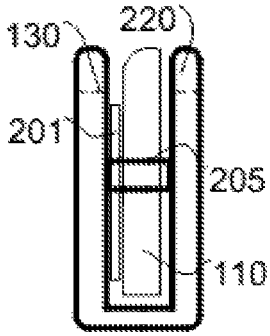
Figure 2C:
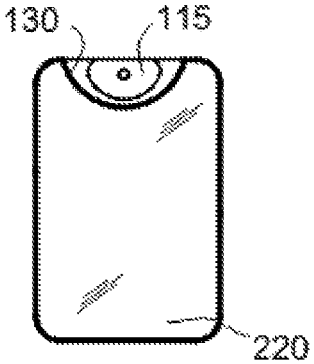
Figure 2D:
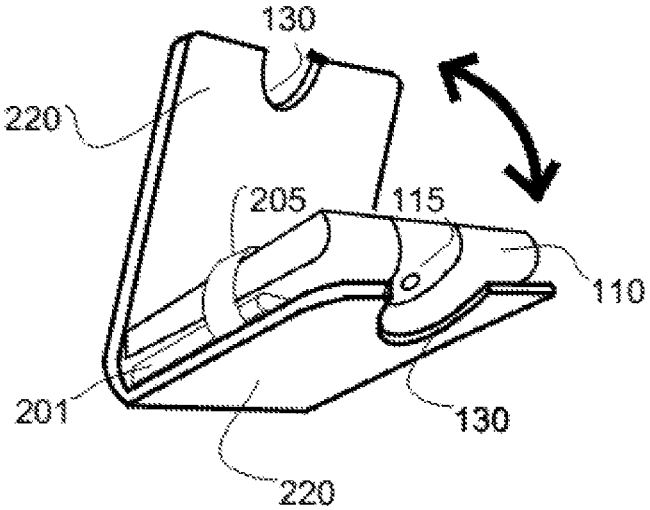
FIG. 2D is an isometric view of the second embodiment.
Figure 3A:
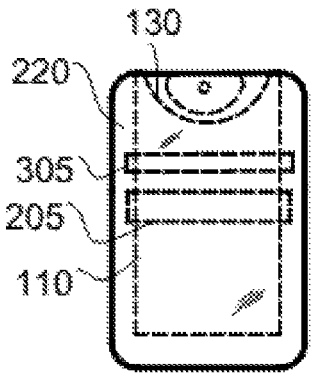
FIG. 3A, FIG. 3B, and FIG. 3C are front, side and back views, respectively, of a third embodiment 300 of the invention illustrating two adjustable bands 205 and 305 used in this embodiment with bifold protective member 220 and bottle 110 for additional storage of personal items.
Figure 3B:
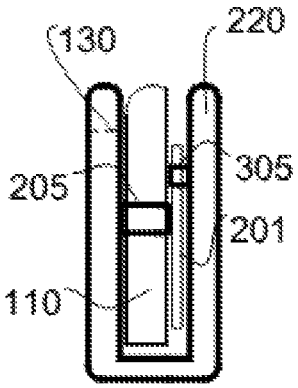
Figure 3C:
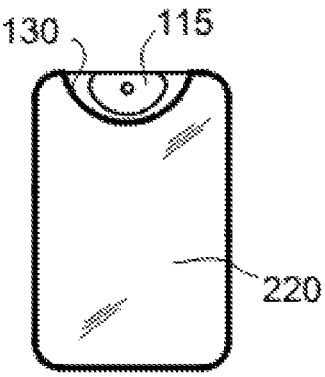
Figure 3D:
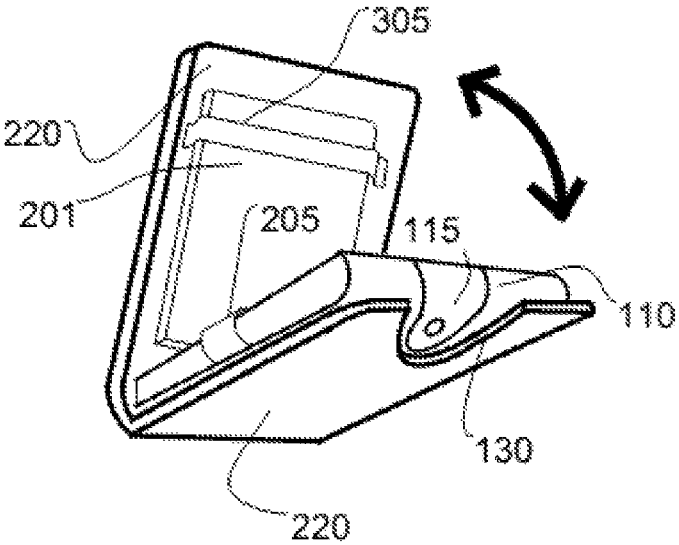
FIG. 3D is an isometric drawing of this embodiment.

FIG. 2A through FIG. 2D illustrate a second embodiment 200 of this invention whereby the bottle 110 is removably coupled to the protective member 220 with adjustable band 205. Adjustable band 205 may be attached to the protective member 220 by gluing or otherwise attaching its ends to the protective member 220 (as depicted in FIG. 2A, FIG. 2B, and FIG. 2D) and removably couples bottle 110 to the protective member 220. In a similar contemplated embodiment, adjustable band 205 may also surround personal item 201 and protective member 220, as a continuous elastic band which requires no secondary manufacturing, although this embodiment is not shown in FIG. 2D. The thick double arrow in FIG. 2D indicates that the bifold protective member 220 is moveable and substantially closeable to become contiguous with personal item 201 and adjustable band 205. Protective member 220 in FIG. 2A-FIG. 2D is a bifold which may substantially enclose the bottle 110 and personal item 201, while providing a cutout 130 to allow dispensing of the bottle's contents through dispensing mechanism 115 without removing the bottle 110 from the protective member 220. Personal item 201 may be removably disposed between protective member 220 and bottle 110 without the additional support of adjustable band 205, or may be further supported against the bottle 110 by adjustable band 205 (as shown in FIG. 2B and FIG. 2D.) An example personal item 201 is a prepackaged condom. Other personal items may also be stored and removably disposed between protective member 220 and bottle 110.

Invention Embodiment #3

FIG. 3A through FIG. 3D illustrate an embodiment 300 of the invention similar to embodiment #2 whereby an additional adjustable band 305 is provided that is attached to the protective member 220. Adjustable band 305 provides for storage of personal item 201. Alternately, but not shown, personal item 201 may be stored by adjustable band 205 (as was shown in FIG. 2D), or may be simply disposed between bottle 110 and support 220 with no additional direct support from adjustable band. In both alternates herein described, the personal item 201 is removably disposed between the bottle and the protective member 220. (In a similar contemplated embodiment, adjustable band 305 may also surround personal item 205 and protective member 220, as a continuous elastic band which requires no secondary manufacturing, although this embodiment is not shown.) The thick double arrow in FIG. 3D indicates that the bifold protective member 220 with personal item 201 attached to the bifold protective member 220 with adjustable band 305 is moveable to become substantially contiguous with the bottle 110 and adjustable band 205. Protective member 220 can be a bifold which substantially encloses the bottle 110, while providing a cutout 130 to allow dispensing of the bottle's contents through dispensing mechanism 115 without removing the bottle 110 from the protective member 220. Multiple personal items can be stored between the bottle member 110 and protective member 220 using adjustable band coupling means 205 or 305.

Invention Embodiment #4

Figure 4:
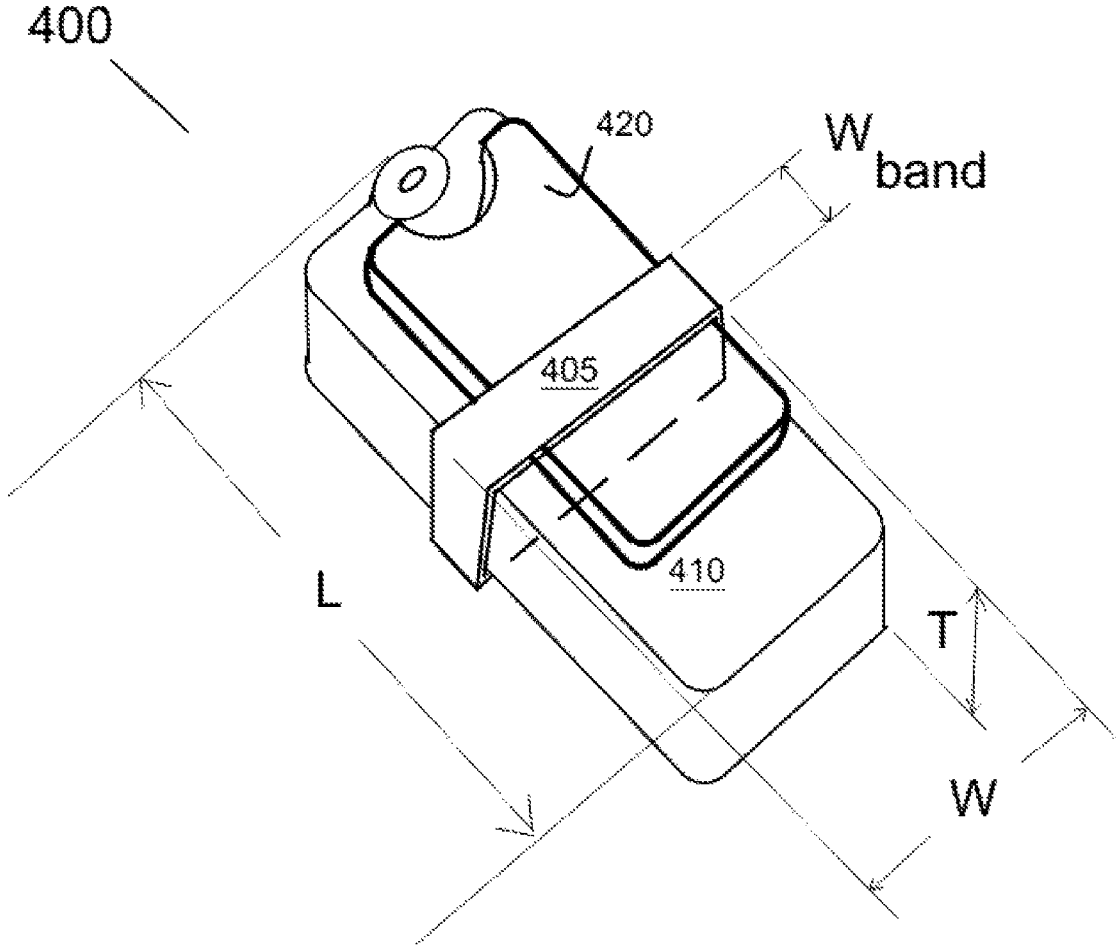
FIG. 4 shows an embodiment that illustrates dimensional references of the invention.

Another embodiment 400 of this invention is illustrated by FIG. 4. Embodiment 400 comprises bottle 410, adjustable band 405 and protective member 420. Personal item(s) are not shown in FIG. 4, but may be disposed between protective member 420 and bottle 410. FIG. 4 depicts overall dimensions of the invention.

The preferred size of this invention allows it to fit inside a purse, pocket or other personal receptacle. A personal receptacle may have a range of sizes, from a small pocket to large purse or glovebox, and therefore the size of a compact holder may be a range of overall sizes or dimensions. To illustrate, FIG. 4 shows a substantially planar and rectangular invention, having planar dimensions W (width) and L (length). The compact holder also has thickness T, and the at least one adjustable band has a width $W_{band}$. Referring to this example illustration, the preferred compact holder size for a clothing pocket is about 1 to 4 inches wide (W) by about 2 to 5 inches long (L) by about one-half to 1 inch thick (T). More preferably and for a specific compact holder to store a lens cleaner in the bottle with a cleaning cloth as the personal item, the overall dimensions of the compact holder are about 2¼ inches wide by about 3½ inches long by about ⅝ inches thick. Larger sizes for the compact holder, with W between about 3 and 6 inches, L between about 4 and 12 inches, and T between about one-half and 2 inches are also contemplated, with overall width, length, and thickness limited only by the size of the personal receptacle with which it will be used and the personal choice of the user. Although FIG. 4 is an illustration for a substantially planar and rectangular compact holder, other three-dimensional geometries for the compact holder are contemplated having similar overall dimensions. The adjustable band is also contemplated to have a range of widths $W_{band}$, depending on the overall size of the compact holder and the compressive force needed to protectively hold the personal article between the bottle and protective member. Preferred widths $W_{band}$ for the adjustable band are about one-eighth to 2 inches.

Invention Embodiment #5

Figure 5C:
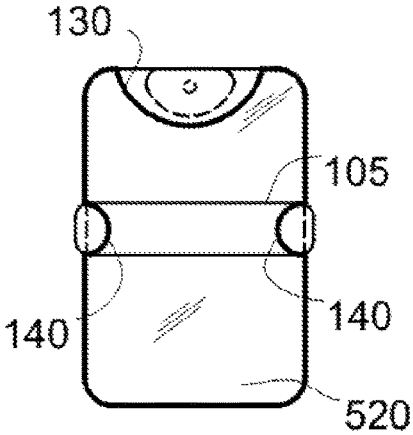

Another embodiment 500 of this invention, similar to embodiment 100, is illustrated by FIG. 5A, FIG. 5B, and FIG. 5C and comprises a small flat bottle 110 with dispensing mechanism 115 (depicted here as a spray nozzle), a protective member 520 comprising a cutout section 130 in the protective member 520 so that the dispensing mechanism 115 may be accessed and utilized while the bottle 110 is still in place with the protective member 520, and adjustable band 105 that couples the bottle 110 to protective member 520. Personal items 201 and 202 are depicted disposed between bottle 110 and protective member 520. In contrast to protective member 120 in embodiment 100 which comprises sidewalls and a cavity 125, this embodiment 500 depicts a flat protective member 520 comprising no sidewalls or cavity, however, gap 525 is depicted.

To help position and secure the adjustable band 105, at least one cutout section (or cutout) 140 may be provided on the edge(s) of the protective member 520. FIG. 5A and FIG. 5C depict an embodiment whereby there are two cutouts 140. These cutouts also reduce the profile of the adjustable band, and minimize "catching" on other personal items or clothing.

OTHER EMBODIMENTS

Personal items 201 and 202 in the invention embodiments #1 through #4 are understood to represent various items including, but not limited to, a cleaning cloth, money, credit card, identification card, business card, prepackaged condom, prepackaged bandage, transdermal patch, ear buds, and small electronic device, or combinations or multiples thereof, that may be held or stored by the invention. It is also understood that referenced personal items 201 and 202 each may represent more than one item in embodiments #1 through #5.

The protective member (e.g., 120 in FIG. 1B and FIG. 1C; 220 in FIG. 2A-FIG. 2D; 220 in FIG. 3A-3D; 420 in FIG. 4; and 520 in FIG. 5B-FIG. 5C) can be comprised of any material including, but not limited to leather, wood, metal, glass, plastics, elastomers, composite material, and combinations thereof (e.g., such as a silicone-coated polycarbonate or laminated wood.) The protective member may be flexible while still providing sufficient support to hold personal items.

Although this invention has been described in specific detail with reference to the enclosed detailed description and invention embodiments, it will be understood that many variants, modifications and combinations of the invention embodiments may be effected within the spirit and scope of the invention as described in the appended claims.

The invention claimed is:

1. A compact holder comprising:

at least one personal item;

a fluid dispensing bottle;

at least one adjustable band; and a protective member having no sidewalls, wherein:

said compact holder is capable of fitting into and being transported in a purse, a clothing pocket, a glove compartment of a car, or an under-seat travel pouch of a bicycle;

said fluid dispensing bottle is removably coupled to said protective member having no sidewalls by said at least one adjustable band;

said fluid dispensing bottle can hold a dispensable fluid;

said fluid dispensing bottle has a fluid dispensing bottle surface contiguous with said at least one personal item;

said fluid dispensing bottle has a fluid dispensing mechanism;

said at least one personal item is disposed between said fluid dispensing bottle and said protective member having no sidewalls;

said protective member having no sidewalls has a protective member surface contiguous with said at least one personal item;

wherein said protective member having no sidewalls further comprises at least one cutout aligned for unobstructed dispensing of said dispensable fluid from said fluid dispensing mechanism, and further wherein said fluid dispensing mechanism is located so as to dispense the fluid open to the air over the personal item and through said at least one cutout aligned for unobstructed dispensing.

2. The compact holder of claim 1, wherein said protective member surface has a geometry that mates with the geometry of said fluid dispensing bottle surface.

3. The compact holder of claim 1, in which the protective member having no sidewalls further comprises at least one cutout to position and secure said at least one adjustable band.

4. The compact holder of claim 1, wherein the at least one personal item is selected from the group consisting of a cleaning cloth, money, credit card, identification card, business card, prepackaged condom, prepackaged bandage, transdermal patch, ear buds, and small electronic device.

5. The compact holder of claim 1, wherein said fluid dispensing bottle comprises a fluid dispensing bottle material, said fluid dispensing bottle material is selected from the group consisting of wood, metal, glass, plastics, elastomers, composite material, and combinations thereof.

6. The compact holder of claim 1, wherein the protective member having no sidewalls comprises a protective member material, said protective member material is selected from the group consisting of leather, wood, metal, glass, plastics, elastomers, composite material, and combinations thereof.

7. The compact holder of claim 1, wherein the fluid dispensing mechanism delivers fluid from said fluid dispensing bottle in a form selected from the group consisting of droplet(s), stream, film, spray, mist, and combinations thereof.

8. The compact holder of claim 1, wherein the dispensable fluid is selected from the group consisting of lubricant, cleaners, antimicrobial solution, vitamin solutions, mace, pepper spray, perfume, oils, and lotion.

9. The compact holder of claim 1, wherein the at least one adjustable band comprises an adjustable band material, said adjustable band material is selected from the group consisting of fabric, leather, hook-and-loop, elastomer, and combinations thereof.

10. The compact holder of claim 1, wherein the protective member having no sidewalls further comprises a foldable joint.

11. The compact holder of claim 1, in which the fluid dispensing bottle or the protective member having no sidewalls comprises radio frequency identification (RFID) blocking material.

12. The compact holder of claim 1, further comprising overall compact holder width between 1 and 4 inches, overall compact holder length between 2 and 5 inches, and overall compact holder thickness between one-half and 1 inches.

13. A compact holder comprising:

at least on cleaning cloth;

a fluid dispensing bottle;

at least one adjustable band; and a protective member having no sidewalls, wherein:

said compact holder is capable of fitting into and being transported in a purse, a clothing pocket, a glove compartment of a car, or an under-seat travel pouch of a bicycle;

said fluid dispensing bottle is removably coupled to said protective member having no sidewalls by said at least one adjustable band;

said fluid dispensing bottle can hold a dispensable fluid, wherein said dispensable fluid is a lens cleaner;

said fluid dispensing bottle has a fluid dispensing bottle surface contiguous with said at least one cleaning cloth;

said fluid dispensing bottle has a fluid dispensing mechanism that delivers a spray;

said at least one cleaning cloth is disposed between said fluid dispensing bottle and said protective member having no sidewalls;

said protective member having no sidewalls has a protective member surface contiguous with said at least one cleaning cloth;

wherein said protective member having no sidewalls further comprises at least one cutout aligned for unobstructed spraying of said lens cleaner from said fluid dispensing mechanism, and further wherein said fluid dispensing mechanism is located so as to spray said lens cleaner past said at least one cleaning cloth and through the cutout.

14. The compact holder of claim 13, wherein the fluid dispensing bottle is flat.

15. The compact holder of claim 13, wherein said protective member having no sidewalls further comprises at least one second cutout to position and secure said at least on adjustable band.

16. A method for holding at least one personal item comprising: providing the compact holder of claim 1.

17. The method of claim 16, further comprising removably attaching said compact holder of claim 1 to another object with said at least one adjustable band of claim 1.

* * * * *